US005553402A

United States Patent [19]

Marega et al.

[11] Patent Number: 5,553,402

[45] Date of Patent: Sep. 10, 1996

[54] SKI-BOOT WITH IMPROVED PADDING AND SLIDABLE TONGUE

[75] Inventors: Antonello Marega; Mario Sartor, both of Volpago, Italy

[73] Assignee: TECNICA SpA, Treviso, Italy

[21] Appl. No.: 353,331

[22] Filed: Dec. 5, 1994

[30] Foreign Application Priority Data

Dec. 7, 1993 [IT] Italy ..... TV93A0112
Dec. 7, 1993 [IT] Italy ..... TV93U0055

[51] Int. Cl.[6] ..... A43B 5/04; A43B 23/26

[52] U.S. Cl. ..... 36/117.7; 36/54; 36/118.2

[58] Field of Search ..... 36/117, 10, 118, 36/119, 120, 121, 54

[56] References Cited

U.S. PATENT DOCUMENTS

| | | | |
|---|---|---|---|
| 3,067,531 | 12/1962 | Scott | 36/120 |
| 3,599,351 | 8/1971 | Check | 36/118 |
| 4,193,215 | 3/1980 | Hensler | 36/117 X |
| 4,888,889 | 12/1989 | Sartor | 36/117 |
| 4,920,666 | 5/1990 | Marega | 36/119 |
| 5,174,050 | 12/1992 | Gabrielli | 36/117 |
| 5,365,679 | 11/1994 | Chemello | 36/117 |

FOREIGN PATENT DOCUMENTS

| | | |
|---|---|---|
| 0317764 | 5/1989 | European Pat. Off. . |
| 0371915 | 6/1990 | European Pat. Off. . |
| 0438079 | 7/1991 | European Pat. Off. . |
| 0569829 | 11/1993 | European Pat. Off. . |
| 2475370 | 2/1981 | France . |
| 8900015 | 6/1988 | WIPO . |

*Primary Examiner*—Ted Kavanaugh
*Attorney, Agent, or Firm*—Griffin, Butler, Whisenhunt & Kurtossy

[57] ABSTRACT

In a ski-boot comprising a rigid shell (22), a boot leg (24) hinged to the shell (22) and an inner shoe (122). There is a padding (26) connected to the inside rear part of the boot leg (24) which allows the padding (26) to move between two limit positions, a lowered and a pulled up position. There is also a longitudinally slidable tongue (132) interposed between the shell (22) and the inner shoe (122) to cover a front opening (128) in the shell.

17 Claims, 6 Drawing Sheets

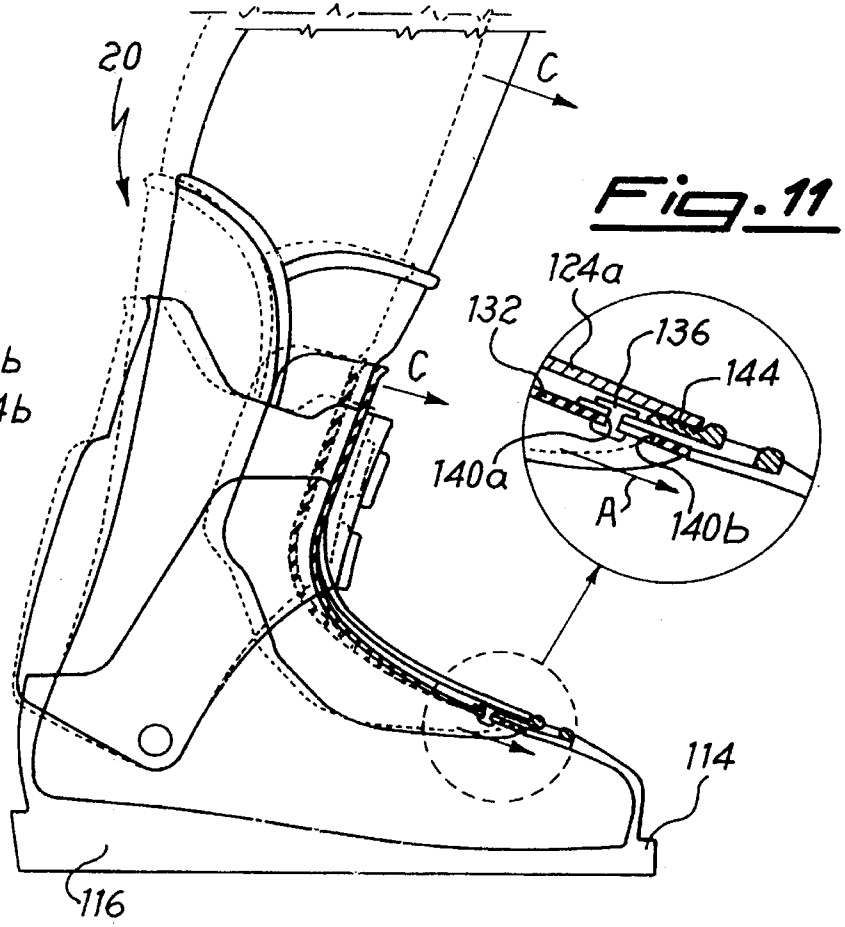
Fig. 10
Fig. 11
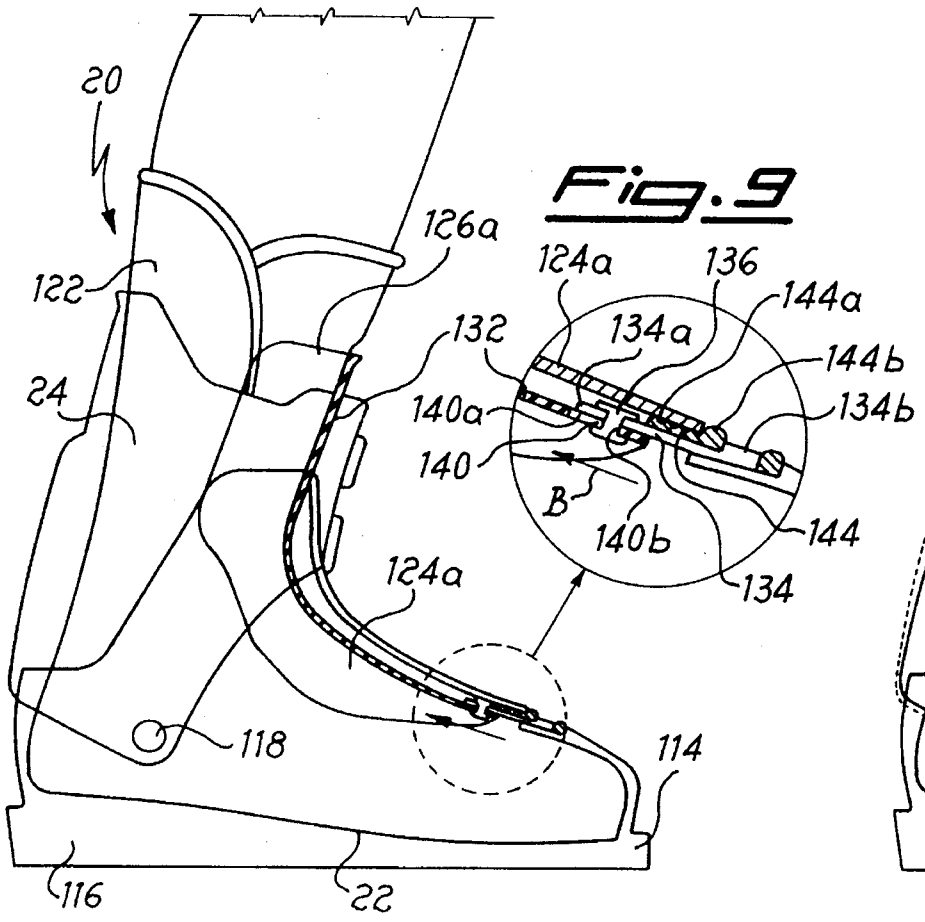
Fig. 8
Fig. 9

SKI-BOOT WITH IMPROVED PADDING AND SLIDABLE TONGUE

The present invention relates to a ski-boot of the type comprising a rigid shell and a boot leg hinged to the shell so as to wrap the lower portion of the skier's leg and allowing the leg to bend. An inner lining shoe is housed inside the shell and the boot leg in order to make more comfortable the fit of the ski-boot avoiding any direct contact between the foot, on one side, and the rigid shell and boot leg, on the other side; furthermore, the inner shoe wraps the foot and remains in a close contact with the shell in order to transmit the control movements of the skier's foot to the ski.

BACKGROUND OF THE INVENTION

In particular, the ski-boot is of the central-entry type whereby, in order to put the boot on a backward displacement of a part of the boot leg is required. In order to facilitate the entry of the foot into the ski-boot, the inner lining shoe is of the central-entry type, namely it has a vertical opening extending along its rear part from the top end of the upper up to the sole area.

Furthermore, there is an inner padding, rigidly connected to the top end of the boot leg, to cover the opening of the inner shoe and thus completely wrapping the lower portion of the wearer's leg. However, these embodiments have various drawbacks in that the wearer's leg calves may be and are of various sizes. In particular, for legs having small calves, once the latching levers of the shell are tightened, the tightening of the boot leg around the leg is not effective; vice versa, for legs having big calves the tightening operation is difficult and furthermore, a poorly comfortable fit is obtained.

Finally, both the shell and the boot leg have, in their front part, two opposite edges defining a longitudinal front opening extending from the toe portion of the ski-boot in order to allow the foot to enter into the ski-boot and then into the inner shoe.

The ski-boots according to the prior art have a tongue firmly fastened at one of its ends to the inner shoe to cover the opening. In order to further facilitate the entry of the foot into the ski-boot, the distance between the shell portion in contact with the instep and the shell portion adapted to house the heel must be much greater than the distance between the instep and the heel; in this case the contact between the shell and the instep is ensured by suitably fastening the shell around the inner shoe.

Owing to the non-rigidity of the inner shoe and to the pre-existent clearance between the foot and the shell at the instep, the transmission of the foot control movements to the ski through the boot-ski is not optimum. Furthermore, when the shell is tightened around the inner shoe and thus on the tongue, the latter hinders the tightening of the edges of the ski-boot and often causes localized pressure on some critical area of the foot upper surface; similarly, upon bending the leg and thus the boot-leg in the skiing exercise, the tongue may hinder the bending of the boot leg causing again or increasing the previously described drawback. As a matter of fact the tongue of the inner shoe of the ski-boot operates in the same manner as the tongue of a standard laced shoe; if the laces are tightened firmly and quickly without stretching the tongue, the latter is deformed causing intolerable localized pressure on the foot upper surface of the foot. However, in a ski-boot it is not possible to use the usual method utilized by a person who wears a laced footwear, namely to pull the tongue upward before tightening the laces, since the tongue of the inner shoe is no longer accessible upon starting the tightening of the fastening levers of the ski-boot.

The aim of this invention is to provide a ski-boot such so as to adjust itself to different calf shapes, wherein the contact between the shell and/or the boot leg, from one side, and the inner shoe, from the other side, is more effective when the ski-boot is fastened and wherein, at the same time, the localized pressure on the foot upper surface is avoided.

SUMMARY OF THE INVENTION

The aims are achieved by a ski-boot of the previously indicated type namely of the type comprising a rigid shell, a boot leg hinged on the shell, a padding connected to the inside rear part of the boot leg and an inner lining shoe. The shell and said boot leg has, in the front part, two opposite edges defining a longitudinal opening which extends from the toe portion of the ski-boot. The invention is characterized in that said inner padding of the boot leg is fixed to the latter by connecting means which allow said inner padding to be moved between two limit positions, respectively, the lowered and the pulled up one, with reference to the top edge of the boot leg. The ski-boot comprises a tongue, interposed between said inner shoe, said shell edges and said boot leg edges to cover the longitudinal opening, the tongue being connected to the shell so as to slide longitudinally with respect to the shell for a distance. The ski-boot according to the invention has various advantages among which are that the ski-boot fits easily to the various calf sizes by adjusting the position of the padding: with small calves the padding is pulled up whereas with big calves the same is lowered. Another advantage is due to the possibility of adjusting, in the rear part of the ski-boot, the height of the inner shoe by only adjusting the position of the padding.

As it can be easily understood, during the tightening of the fastening levers of the shell and of the boot leg, the tongue, being longitudinally movable, is displaced in the direction of the shell portion corresponding to the heel thus originating, especially at the instep, a more effective contact between the foot and the shell. Moreover, the tongue is not deformed as it may be in the traditional ski-boots or in the standard footwear provided with a tongue, but it is displaced such as to avoid pressure concentration areas. Similarly, when the leg and thus the boot leg are bent forward, the tongue is not deformed but is displaced towards the toe area offering similar advantages.

Another advantage lies in the fact that during the bending of the leg, namely when the boot leg is bent forward towards the toe area, the forward displacement of the tongue facilitates the bending of the boot leg. Finally, the edges of the boot leg and of the shell may slide onto the tongue thus increasing the flexibility of the ski-boot and without hindering the bending of the leg.

According to a first preferred embodiment of this invention, in said lowered limit position, a rear surface of said padding is in contact with the adjacent inner surface of the boot leg and, in said pulled up limit position, the rear surface of said padding is not in contact with the adjacent inner surface of the boot leg so as to form a cavity adapted to receive an insert member for shimmimg, supporting and locking.

In a variant of the previous embodiment intermediate positions are provided to stop said padding between the two limit positions.

In a particular embodiment of this invention, the ski-boot is provided with a sealing member (the so-called "water gard") interposed between the shell and the tongue, having not only the well-known function of eliminating the water seepages but also that of progressively and elastically limiting the forward bending of the boot leg, as it will be more fully explained in the following description. In this manner the impulsive stresses, to which the skier's foot and leg undergo during the skiing activity, are gradually absorbed thus providing several advantages.

BRIEF DESCRIPTION OF THE DRAWINGS

These and other advantages will be evident from the following detailed description made with reference to the drawings which illustrate an embodiment given as a non-limiting example. In the figures:

FIG. 8 is a longitudinal view of the same ski-boot, the tongue being shown in cross-section and fully displaced towards the heel area;

FIG. 9 illustrates an enlarged particular of FIG. 8;

FIG. 10 is a longitudinal view of the same ski-boot, the tongue being shown in cross-section and fully displaced towards the toe area;

FIG. 11 illustrates an enlarged particular of FIG. 10;

DESCRIPTION OF PREFERRED EMBODIMENTS

Figure 1:
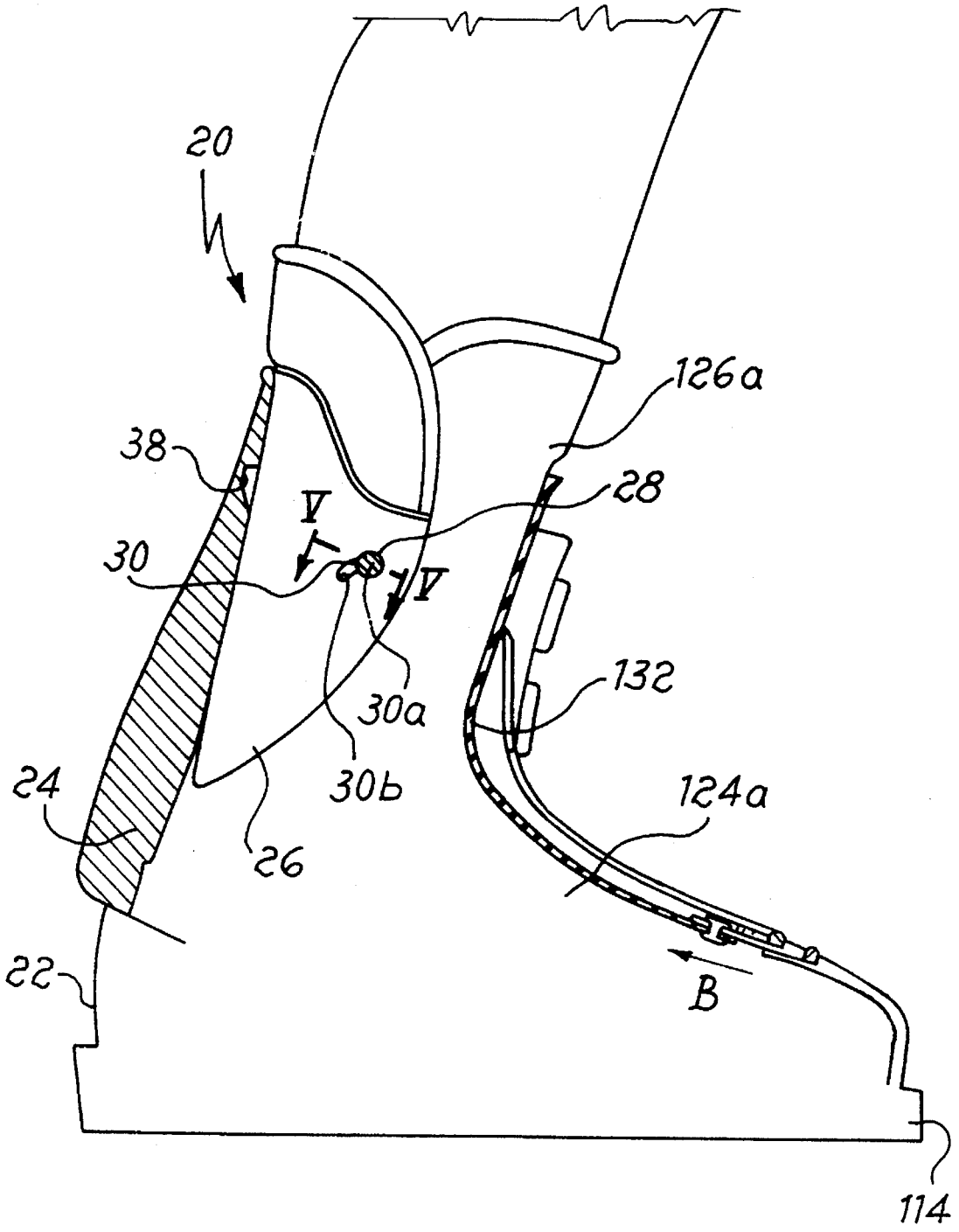
FIG. 1 is a side elevation, in partial cross-section, of a ski-boot according to the invention wherein the padding, entirely shown, is lowered in the limit position.

In FIG. 1 a ski-boot is illustrated, indicated by the reference 20 on the whole, comprising a rigid shell 22 on which a toe area 114 and a heel area 116 (see FIG. 8), longitudinally opposite each other, are identified.

A boot leg 24 is hinged in a well-known manner to the shell 22, by pins 118 (see FIG. 8), the boot leg having the function of wrapping the lower portion of the leg and simultaneously allowing the bending of the leg with respect to the foot. In order to make comfortable the fit of the ski-boot 20, a inner lininig shoe 122 of the rear-entry type (see FIG. 8) is housed in the shell 22 and boot leg 24 and, on its upper part, it has an opening extending from its top end up to its sole area; this inner shoe being the subjet matter of a co-pending application filed concurrently therewith.

With reference to FIGS. 1 to 5, an inside padding 26 is interposed, at the opening of the inner shoe 122 (see FIG. 8), between the boot leg 24 and the inner lining shoe 122 and its contour corresponds to that of the opening of the inner lining shoe. Both opposite parts of the padding 26, symmetrically arranged with respect to the longitudinal plane of the ski-boot, are provided with a pin 28 (see FIG. 1) having an enlarged head slidable in a respective curvilinear slit or groove 30 provided in the boot leg 24, the groove having longitudinally opposite ends 30*a*,30*b*.

Figure 2:
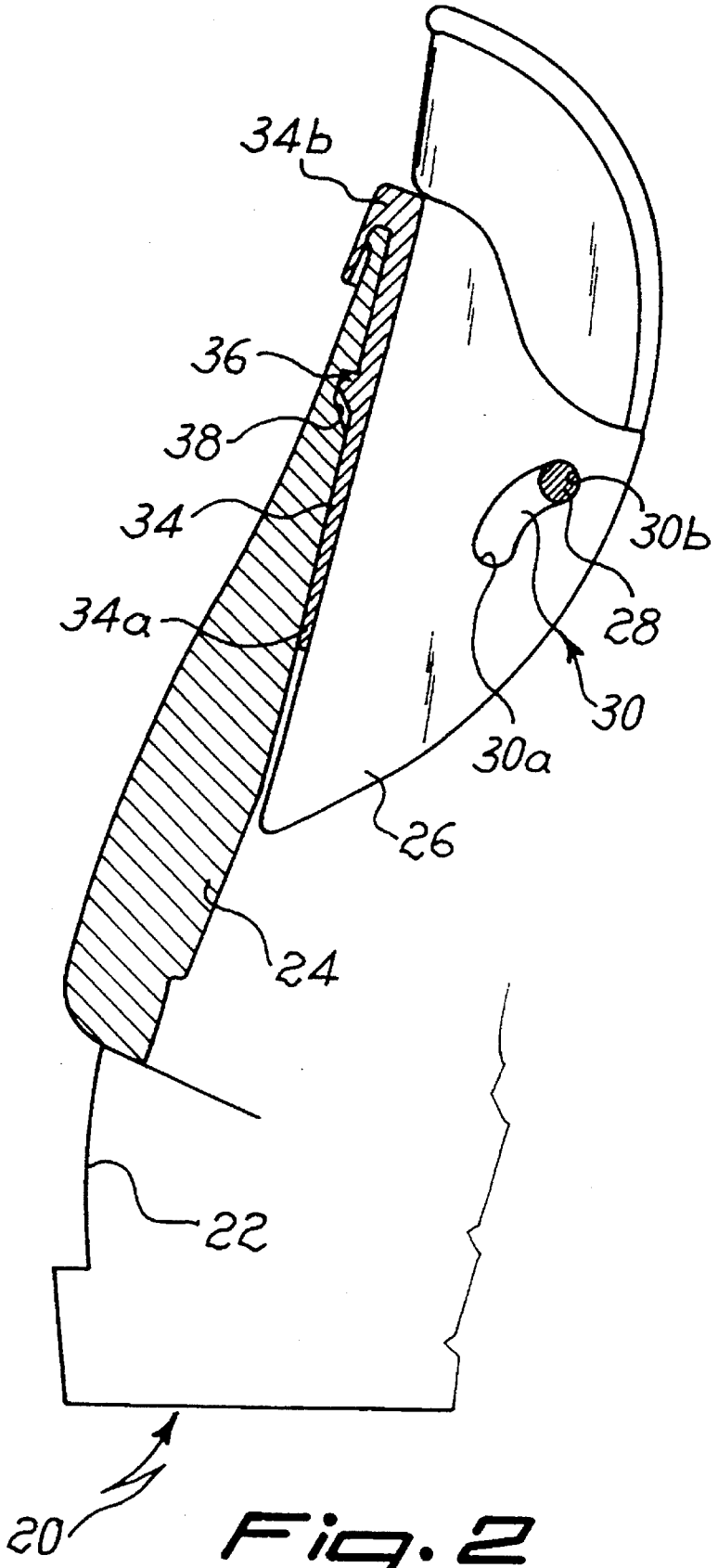
FIG. 2 is a partial longitudinal section of the same ski-boot wherein the padding, entirely shown, is in the pulled up limit position and a supporting member is interposed between the padding and the boot leg.
Figure 3:
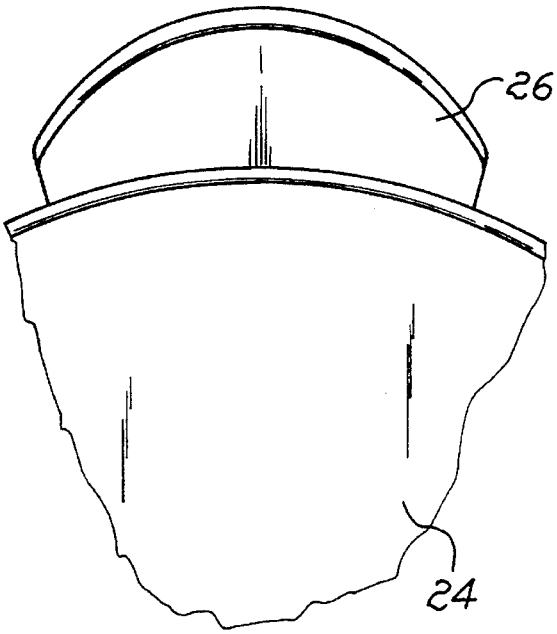
FIGS. 3 and FIG. 4 are partial rear views of the same ski-boot wherein the padding is positioned as indicated in FIGS. 1 and 2 respectively.
Figure 4:
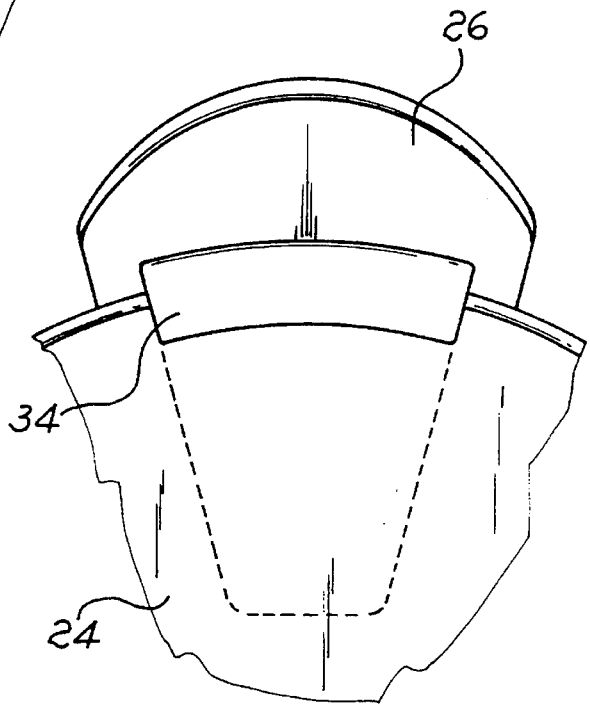
Figure 5:
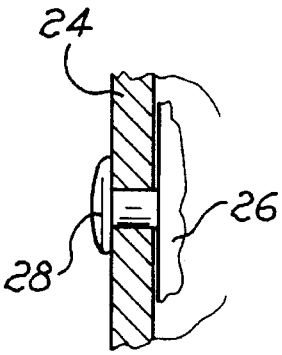
FIG. 5 is a cross-section of FIG. 1 taken along line V—V.

The profile of the curvilinear grooves 30 is such that it allows the padding 26 to be moved from a first limit position, where the padding abuts against the boot leg 24 and the pins 28 abutted on the ends 30*a* of the respective grooves 30 (see FIG. 1), to a second limit position, where the padding is separated from the boot leg 24 and the pins 28 abutted on the ends 30*b* of the respective grooves 30 (see FIG. 2). In the latter position, a cavity is formed between the padding 26 and the boot leg 24 and an insert member 34 (see FIG. 2) is placed into the cavity as a wedge for supporting and blocking the padding, the insert member being suitably mounted onto the boot leg 24, as it can be better appreciated hereinafter and having the function of securing the padding 26 to the boot leg 24 in a firm manner.

FIG. 2 shows that the insert member 34 is elongated and wedge-like shaped and has longitudinal opposite ends 34*a*, 34*b*: the pointed end 34*a* is turned towards the sole of the ski-boot whereas the widened end 34*b* is hook-like shaped so as to engage the top end of the boot leg 24. Finally, the inserting member 34, on its part facing the boot leg 24, is provided with a projection 36 which is engaged in a corresponding notch 38 made in the inner part of the boot leg.

In order to insert the supporting member 34 between the boot leg 24 and the padding 26, it is sufficient, starting from the position indicated in FIG. 1, where the pins 28 are abutted on the ends 30*a* of the respective grooves 30, to move the padding 26, causing the pins 28 to slide along their respective grooves up to the position where they abut on the opposite ends 30*b* so that the padding 26 moves and rises with respect to the boot leg 24. At this point, as shown in FIG. 2, the supporting member 34 may be placed between the boot leg 24 and the padding 26, the top hook-like end 34*b* hooked to the top end of the boot leg 24 and the projection 36 of the insert member 34 engaged into the notch 38 of the boot leg 24 so as to secure both the supporting member 34 and padding 26.

Figure 6:
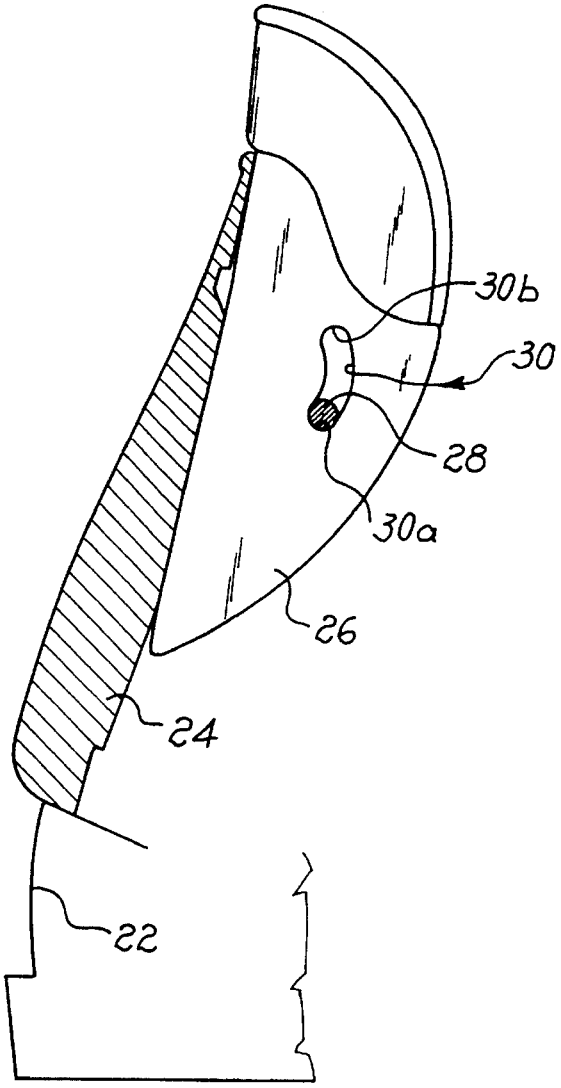
FIG. 6 is a partial longitudinal section of a ski-boot according to a first variant wherein, in said lowered position, the padding is in contact with the whole adjacent inner surface of the boot leg.
Figure 7:
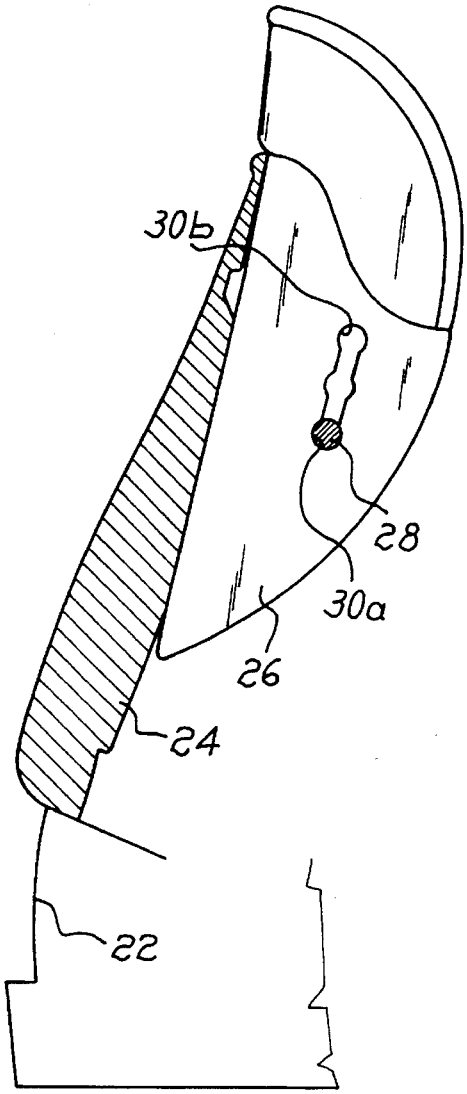
FIG. 7 is a partial longitudinal section of a ski-boot according to a second variant wherein there are intermediate stopping positions for said padding.
Figure 12:
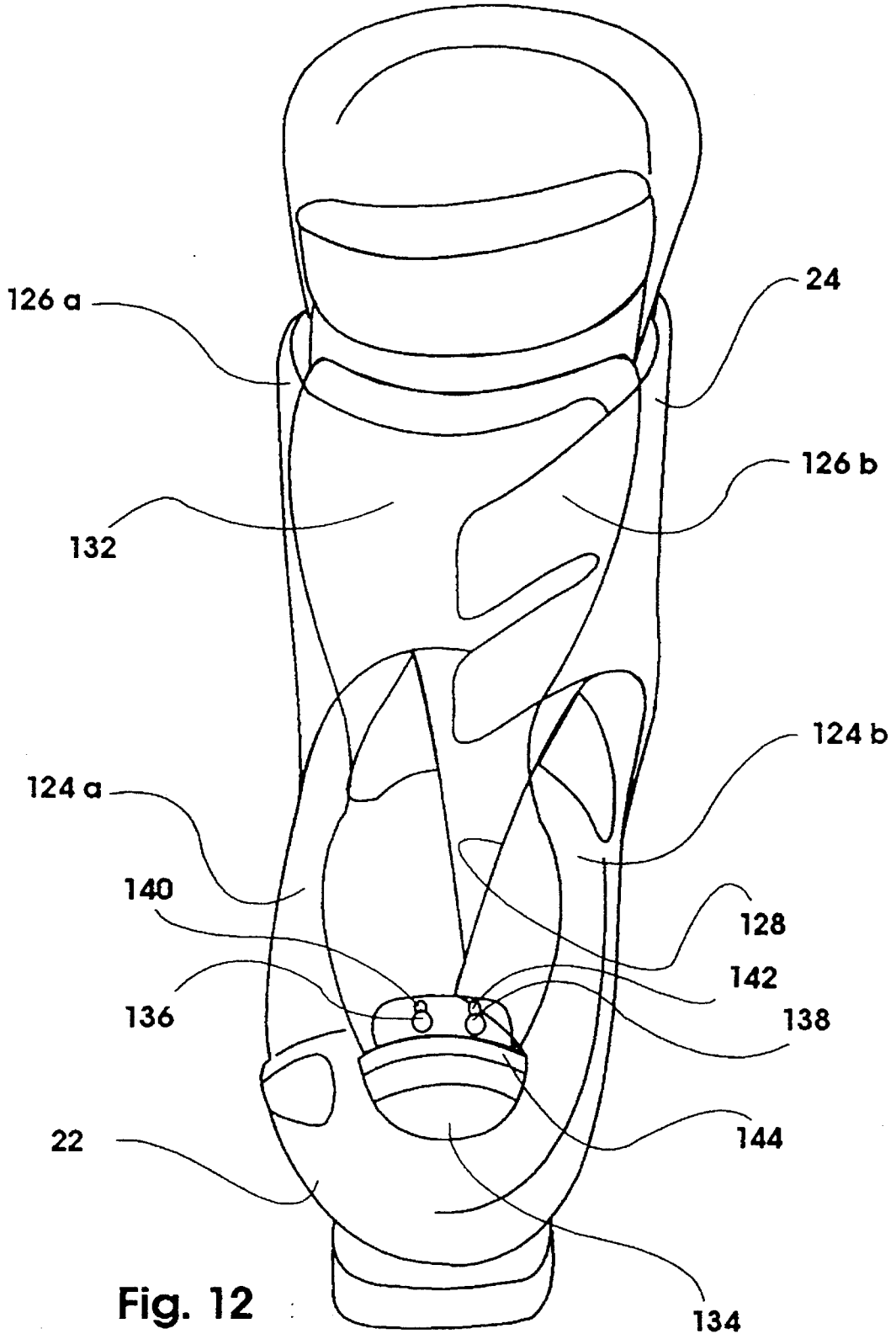
FIG. 12 is a schematic front view of the same ski-boot.

FIGS. 6 and 7 show a first and second variant of this invention embodiment respectively, wherein for illustrative purposes the same reference numbers are used to indicate similar elements.

Particularly, as can be seen in FIG. 6, the curvilinear profile of the slit or groove 30 has the opposite ends 30*a*,30*b* parallelly aligned with respect to inner edge of the boot leg 24, this edge being arranged in the longitudinal plane of the ski-boot and adjacent to the padding 26, so that the padding 26, in the pulled up position, abuts against the adjacent inner surface of the boot leg 24.

Finally, as it can be seen in FIG. 7, the curvilinear profile of the slit or groove 30 is rectilinear and has two opposite ends 30*a*,30*b* defining the lowered and pulled up position, respectively, of the inner padding 26.

Furthermore, the slit or groove 30 is centrally provided with a widening, forming a housing seat for the pin 28, so as to determine an intermediate position for said padding 26.

This structural embodiment allows the adjustment of the position of the padding 26, in particular the lowering of the padding, to permit the putting on of the shoe for legs having big calves, and the pulling up of the same, to permit the putting on of the shoe for legs having small calves, thus obtaining an effective and comfortable fit for both the calf types. Furthermore, knowing that a small calf usually corresponds a long leg, the pulling up operation of the padding, necessary to adapt the ski-boot to small calves, allows the wrapping of long legs in a more thorough and effective manner.

With reference to FIGS. 8 to 11, the shell 22 and the boot leg 24 have, in the front part, two opposite edges, respectively indicated by references 124*a*,124*b* and 126*a*,126*b*, defining a longitudinal opening 128.

A tongue 132 is interposed between the inner shoe 122 and the edges 124*a*,124*b* and 126*a*,126*b* of the shell 22 and boot leg 24 respectively, the tongue being connected to the shell 22 by a longitudinal rigid insert 134 and having the function of covering the opening 128 from the inside of the boot-ski. More precisely, in the rigid insert 134 two portions 134*a* and 134*b* are identified, the first portion 134*a* being nearer the heel 116 and thinner than the second portion 134*b* which is nearer the toe 114. The portion 134*b* is fixed to the shell 22 by means such as seams, whereas the portion 134*a* is provided with two pins 136,138 aligned in a plane perpendicular to the longitudinal axis of the ski-boot and perpendicularly arranged with respect to the shell surface; the pins are freely slidable in respective longitudinal slits 140,142 provided at one end of the tongue 132. The longitudinal slits 140,142 have respective ends 140*a*,140*b* and 142*a*,142*b* so as to allow a longitudinal displacement of the tongue with respect to the shell 22 for a predetermined distance.

In order to avoid water seepage which might occur at the area where the edges 124*a*,124*b* tangentially rise from the shell 22, an L-shaped sealing member 144, having a greater side 144*a* and a smallest side 144*b* is interposed between the rigid inserting member 134 and the edges 124*a*,124*b*: during the closing operation of the ski-boot, the edges 124*a*,124*b* overlap the greater side 144*a* of the sealing member 144 and abut against the smallest side 144*b* of the same member thus achieving a good watertight seal. Moreover, due to the fact that the sealing member 144 is made from an elastically deformable material, the member also acts as an elastic member to limit the forward bending of the boot leg because this bending causes a forward movement of the edges 124*a*,124*b* of the shell 22, this effect being particularly effective when the boot leg 24 is bent forward owing to a sudden bending of the leg during the skiing activity thus reducing the effect of the attendant stresses.

In order to enter the foot into the ski-boot, the tongue 132 is pulled up and then, while the foot is being entered within the ski-boot, is pushed towards the toe area 114 by the foot (as indicated by arrow A in FIGS. 10 and 11) reaching the position indicated in FIGS. 10 and 11 wherein the pins 136,138 are abutted against the ends 140*a*,142*a* of the respective slits 140,142.

Later, by lacing the ski-boot 20, a tightening force is applied on the tongue 132 by the edges 124*a*,124*b* of the shell 22 and by the edges 126*a*,126*b* of the boot leg 24 and the tongue is displaced in the opposite direction with respect to the toe area 114 (as indicated by arrow B of FIGS. 8 and 9) reaching the position indicated in FIGS. 8 and 9 where the pins 136,138 are respectively abutted against the ends 140*b*, 142*b* of the respective slits 140 and 142, a position which may be reached in the case of a particularly tightened lacing.

From this position, if the leg is bent forward (as indicated by arrow C in FIG. 10), both the boot leg 24 and the shell 22 are bent forward and the bending of the leg is facilitated due to fact that the edges 124*a*,124*b* and 126*a*,126*b* may slide onto the tongue 132. During this bending, the tongue 132 is pushed towards the toe area of the ski-boot (arrow A in FIGS. 10 and 11) so as to possibly reach the limit position indicated in FIG. 11. In the same way, the sliding of the edges 124*a*,124*b* of the shell 22 and of the edges 126*a*,126*b* of the boot leg 24 onto the tongue 132 facilitates the return to the upright position of the boot leg 24, the tongue 132 returning to its original position.

From what has been previously stated, it results that the tongue 132, during both the tightening of the ski-boot 20 and the bending in skiing activity, is freely and longitudinally slidable with respect to the shell 22, whereby the problem of the pressure concentration areas, which occurred in both the above-mentioned steps in the traditional ski-boots, is eliminated.

We claim:

1. In a ski-boot (20) having a rigid shell (22), a boot leg (24) with a rear part vertically fixed to the shell (22) but hingedly movable with respect to the shell (22) in a longitudinal direction of the shell, a longitudinal opening in a front part of the ski-boot (20) extending from a toe portion (114) of the ski-boot (20) and defined by edges (124*a*, 124*b*, 126*a*, 126*b*) of the shell (22) and the boot leg (24), and an inner lining shoe (122), the improvement comprising:

(a) an inner padding (26) movably fixed to an inside portion of the rear part of the boot leg (24) by connection means (28, 30) such that the inner padding (26) is vertically movable with respect to a top edge of the boot leg (24) from a lowered limit position where at least a portion of a rear surface of the padding is in contact with an adjacent inner surface of the boot leg to a pulled-up limit position where the rear surface of the padding is not in contact with the adjacent inner surface of the boot leg; and (b) a shell tongue (132) disposed between the inner lining shoe (122) and the edges (124*a*, 124*b*, 126*a*, 126*b*) so as to cover the longitudinal opening (128) and being slidably fastened to the shell (22) at a lower end thereof so as to be movable for a predetermined distance in a longitudinal direction with respect to the shell (22).

2. Ski-boot according to claim 1, wherein in said lowered limit position all of said rear surface is in contact with the adjacent inner surface of the boot leg (24).

3. Ski-boot according to claim 1, wherein there is at least one intermediate position between said limit positions.

4. Ski-boot according to claim 1, wherein said connecting means (28,30) comprise at least one pin (28) fixed to one of the boot leg (24) and padding (26) and the connecting means is slidable in a corresponding groove (30) provided in the other of the boot leg (24) and padding (26).

5. Ski-boot according to claim 4, characterized in that said at least one pin (28) is fixed to the padding (26) and said corresponding groove (30) is provided in the boot leg (24).

6. Ski-boot according to claim 4, wherein there are two pins (28) which slide in corresponding grooves (30) symmetrically and oppositely arranged with respect the longitudinal plane of the ski-boot (20).

7. Ski-boot according to claim 2, wherein in said pulled-up limit position, a supporting member (34) is inserted between the padding and the boot leg so that the padding (26) is fixed to the boot leg (24).

8. Ski-boot according to claim 7, wherein a top end (34*b*) of the supporting member (34) is hook-like shaped and suitable for hooking the top end of the boot leg (24).

9. Ski-boot according to claim 8, wherein said supporting member (34) at a part facing the boot leg (24) is provided with a projection (36) which is engagable in a corresponding notch (38) in the inner surface of the boot leg (24).

10. Ski-boot according to claim 1, wherein the lower end of said shell tongue (132) is fastened by connecting means (134,136,140) to the shell (22) near an area in which the edges (124*a*,124*b*) of the shell (22) rise from the shell at a toe area (114) of the shell.

11. Ski-boot according to claim 10, wherein said connecting means (134,136,140) comprise at least one pin (136,138) fixed to either of said shell (22) and tongue (132) and slidable in a corresponding longitudinal slit (140,142) provided in the other of said shell (22) and tongue (132), between a first position where the at least one pin is abutted against an end (140*b*,142*b*) of the slit (140,142) facing the toe area (114) and a second position where the pin is abutted against an opposite end (140*a*,140*b*).

12. Ski-boot according to claim 11, wherein the at least one pin is constituted by two pins aligned in a plane perpendicular to a longitudinal axis of the ski-boot (20) and slidable in respect to the longitudinal slits (140,142).

13. Ski-boot according to claim 11, wherein said at least one pin (136,138) is fixed to the shell (22) and said slit (140,142) is in the tongue (132).

14. Ski-boot according to claim 13, wherein said at least one pin (136,138) is fixed to an end (134*a*) of a longitudinal rigid insert (134) and an other end (134*b*) of the rigid insert (134) is fixed to the shell (22) near an area where the edges (124*a*,124*b*) of the shell (22) start to rise with respect to the shell at the toe area (114) of the shell.

15. Ski-boot according to claim 14, wherein a sealing member (144) is interposed between said rigid insert (114) and the edges.

16. Ski-boot according to claim 15, wherein said sealing member (144) is of elastically deformable material.

17. Ski-boot according to claim 15, wherein said rigid insert (134) has an upper profile (134*a*,134*b*) against which said sealing member (144) is abutted.

* * * * *